United States Patent [19]

Laurita

[11] 4,231,449

[45] Nov. 4, 1980

[54] FOLDABLE LADDER

[76] Inventor: Joseph N. Laurita, 69-03 62 Rd., Middle Village, N.Y. 11379

[21] Appl. No.: 681,029

[22] Filed: Apr. 28, 1976

[51] Int. Cl.[2] ..... E06C 1/36; E06C 1/383

[52] U.S. Cl. ..... 182/164; 182/70; 182/196; 182/206

[58] Field of Search ..... 182/163, 164, 70, 196–198, 182/206, 155, 156

[56] References Cited

U.S. PATENT DOCUMENTS

| | | | |
|---|---|---|---|
| 266,183 | 10/1882 | Moore | 182/70 |
| 285,569 | 9/1883 | Castle | 182/163 |
| 320,114 | 6/1885 | Bormann | 182/164 |
| 899,552 | 9/1908 | McArthur | 182/198 |
| 1,004,883 | 10/1911 | Knollenberg | 182/24 |
| 2,849,257 | 8/1958 | Woyton | 182/155 |
| 3,077,241 | 2/1963 | Klages | 182/46 |
| 3,344,886 | 10/1967 | Boscarino | 182/70 |
| 3,487,889 | 1/1970 | Horowitz | 182/46 |
| 3,757,896 | 9/1973 | Lee | 182/46 |

*Primary Examiner*—Reinaldo P. Machado
*Attorney, Agent, or Firm*—Ernest F. Marmorek

[57] ABSTRACT

A foldable ladder having a plurality of rigid steps and of rigid links which steps and links are pivotally secured together with pivot pins to result in a rigid ladder in use, but capable of being folded for storage.

1 Claim, 6 Drawing Figures

FOLDABLE LADDER

BACKGROUND OF THE INVENTION

The invention relates to foldable ladders of the type which are folded for storage in the event of an emergency at which time they can be unfolded and used to escape from an elevated structure. These ladders are often used as emergency fire escape means and may be secured in a container outside a window, for immediate use. Similar, though shorter ladders, are often used in boats to permit ease of returning into the boat from, for example, the water.

Foldable ladders are well known and have been in use for many years. An extremely old and very common type of foldable ladder is a so-called rope ladder. These usually comprise a series of elongated rigid steps maintained approximately parallel to each other by two ropes, one secured to each end of the steps. The rope permits rolling the ladders into a cylindrical bundle.

The main disadvantage of the known foldable ladders resides in their lack of apparent stability. As these ladders may find utilization as emergency exits, persons not used to climbing ladders may find themselves in a position when they must use a folding ladder in an emergency. If the ladder feels insecure, one often encounters difficulty in using a ladder for the first time. If the person is at all acrophobic, the use of prior art type foldable ladders can be devastating, if not fatal.

In an endeavor to avoid the deficiencies of the prior art type ladders, the instant invention teaches a ladder which, when in use, provides a relatively rigid structure, while still permitting the ladder to be folded or collapsed into a small space.

DESCRIPTION OF THE PREFERRED EMBODIMENTS

Figure 1:
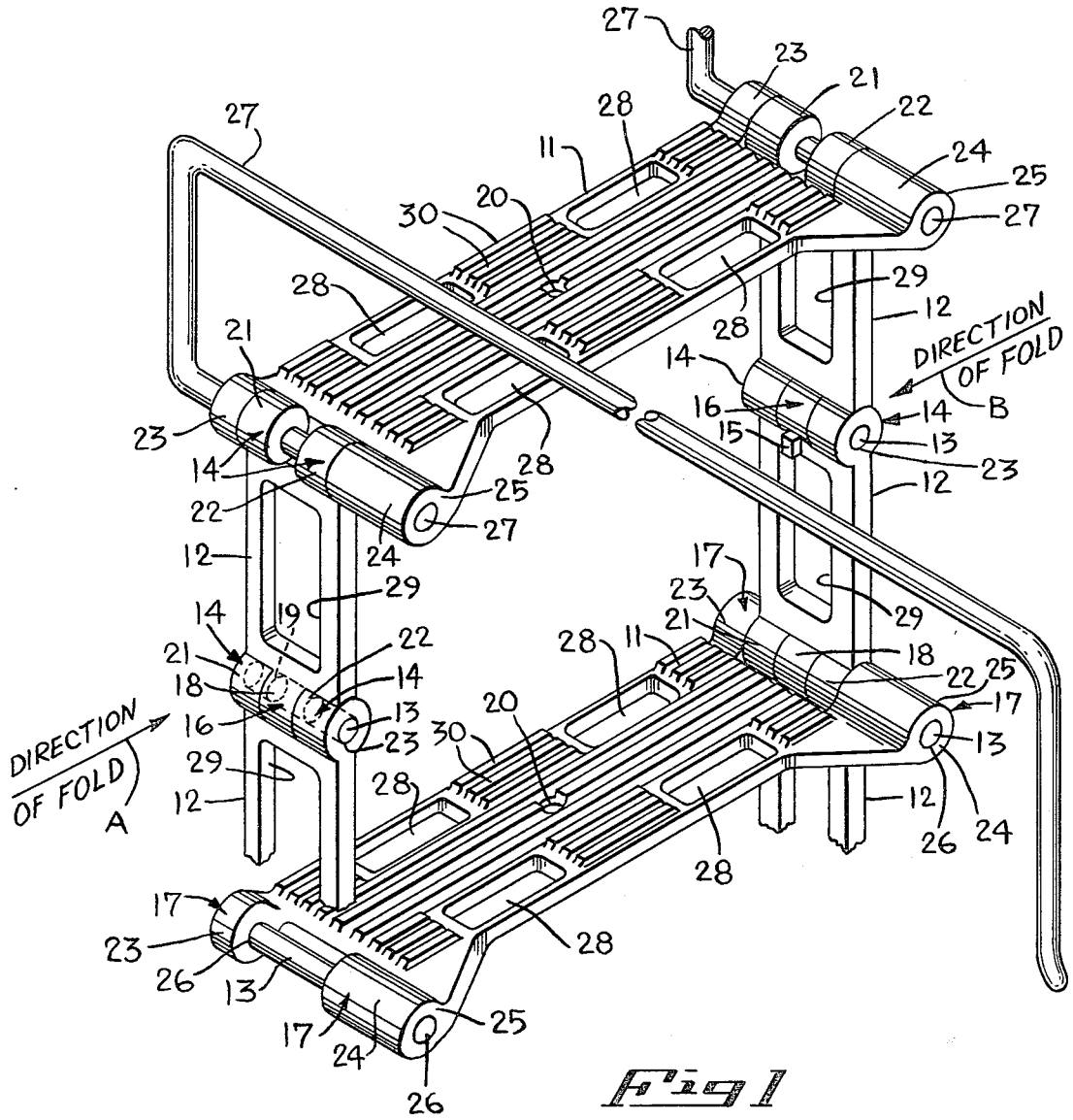
FIG. 1 is a fragmentary large scale perspective view of a ladder according to an embodiment of the instant invention.

In carrying the invention into effect in the embodiment which have been selected for illustration in the accompanying drawings and for description in this specification, and referring now particularly to FIG. 1, a plurality of steps 11 are supported, one below the other to form a ladder, by a plurality of rigid links 12. The links 12 are pivotally secured together and to the steps 11 by pivot pins 13.

The pivot pins 13 are supported, in the links 12, by pivot pin bearing means such as bearings 14, 16 and 17, respectively. These bearing means 14, 16, are so formed and disposed as to permit pivotal securing together of adjacent links 12 using a single pivot pin 13. Thus, in the preferred embodiment shown in FIG. 1, the bearing 16 comprises a single arm 18 with a bore 19 therethrough. The bearing 14 comprises two arms 21, 22 spaced apart for a distance to permit the arm 18 of the bearing 16 to fit therebetween. Each arm 21, 22 of the bearing 14 has a bore 23' therethrough wherein a pivot pin 13 can be inserted through the bore 19 of the arm 18 to journal the arms 18 and 21, 22 pivotably together.

The desired direction of fold of adjoining links 12 is shown in FIG. 1 by arrows A and B. To help restrain folding in an undesirable outward direction, stop means may be provided such as a projection 15 that is formed on the bearing 16, as shown in FIG. 1.

To provide for the pivotal securing of a step 11 to the links 12, in the preferred embodiment shown in FIG. 1, the bearings 17 are provided in the step 11. As shown, these may take the form of arms 23, 24 that extend on opposite sides of the step 11, and are spaced apart for a distance sufficient to permit the arms 18, 21, 22 of the links 12 to fit therebetween. By providing bores 26 in these arms, which bores line up with the bores 19 and 23' in the arms 18, 21, 22 provided in the links 12, a single pivot pin 13 can be received by the bearings 14, 16 and 17 simultaneously. For reasons of safety, the pivot pins 13 can be trimmed to a length that will not protrude beyond the outermost arms.

In order to secure the ladder to a window, hand rails or window rods 27 may be provided. As shown in FIG. 1, the hand rails 27 also form the top pivot pin and are therefore pivotally secured to the ladder.

The ladder may also be provided with apertures such as hand holds 28 in the steps 11, and with hand holds 29 in the links 12, for the convenience of a person using the ladder. The hand holds may, of course, take other forms, for example the links 12 can be made in the form of an "I" wherein one can easily grab the narrow center or web portion of the "I" shape linkage (this embodiment is not shown). The steps 11 may also be formed with ridges 30, molded or otherwise formed therein. These ridges 30 act to provide a relatively non-slip surface on the steps 11. Other non-slip surfaces may be provided instead, as would be evident to a person skilled in the art.

When the ladder is intended for use as a fire escape means, the ladder may be too long to fold conveniently without additional aid. Therefore, apertures 20 may be formed in the steps 11, essentially aligned with each other and a rope or similar means (not shown) can be passed through these apertures 20 and be attached to the bottom step. One need only pull up on the rope, by hand or with a simple winch device (not shown), to fold the ladder for storage.

Other uses for a foldable ladder as herein described, would be obvious to persons using foldable ladders. An example of such a use would be in marine applications wherein a ladder is often used to board a boat from the water.

The material from which the ladder should be manufactured will depend on its final use. Thus, for fire escape purposes, a flame-retarding polymer or similar material (Lexan - S.E., A.B.S., glass-filled material, fiber-filled material) may be used. These materials for the most part, may be conveniently molded into appropriate parts for both the steps and the linkages. The pivot pins may also be of a synthetic polymer or of a metal such as steel.

If used for marine purposes, the possibility of corrosion or other deterioration associated with such applications, must be taken into account when deciding the material to be used.

The ladder may also be provided with a plurality of stand-offs 25 extending from the ladder. These act to keep the ladder apart from a wall or side of a boat or other downwardly extending part of the structure to which the ladder is secured.

Figure 2:
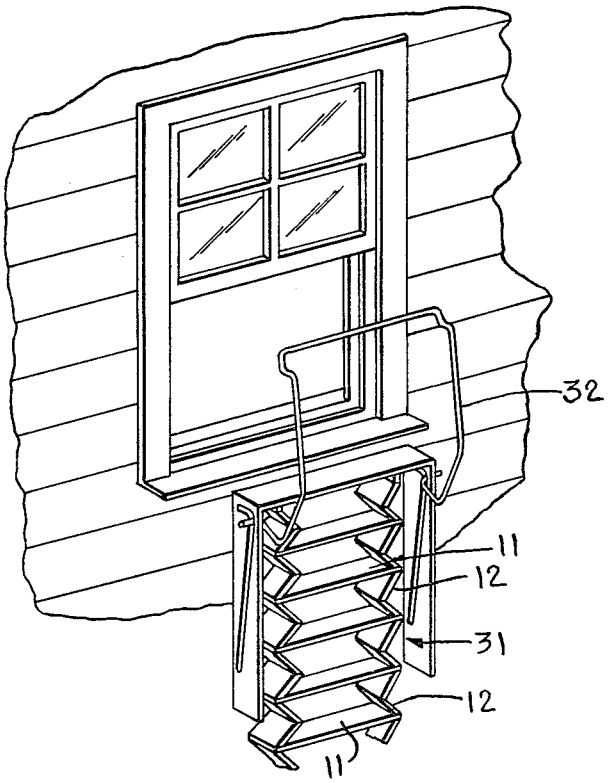
FIG. 2 is a perspecitve view of a modification of a partially open ladder of FIG. 1, showing the top step of the ladder mounted on the inside of a storage container.

In the embodiment shown in FIG. 2, the ladder is shown secured to a storage container such as a box 31, mounted outside of a window. The ladder is pivotally secured to the inside of the box 31. A hand rail or window rod 32 (similar to the hand rail 27 of FIG. 1) is shown secured to the box 31. Although much of the detail of the ladder has been omitted from FIG. 2, for the sake of clarity, the manner of folding the ladder can be seen and is similar to that of FIG. 1. FIG. 2 shows the ladder in a partially folded position.

Adjacent links 12, pivot or fold towards each other on each side of the ladder. This results in the steps 11 moving towards each other to form a small, folded, structure. For the embodiments shown in FIG. 2, the ladder is pulled up into the box 31 and a cover (not shown) is placed over the box 31 to protect and hold the ladder.

Figure 3:
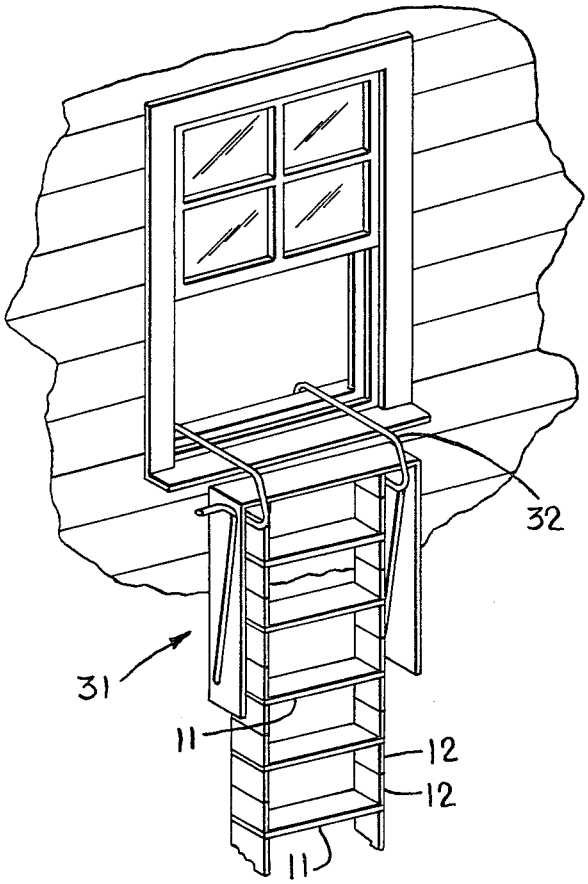
FIG. 3 is a perspective view similar to FIG. 2 in the fully open position.

When the ladder is to be used, its links will be extended to unfold the ladder, and the window rod 32 will engage the window sill, all as shown in FIG. 3.

Figure 4:
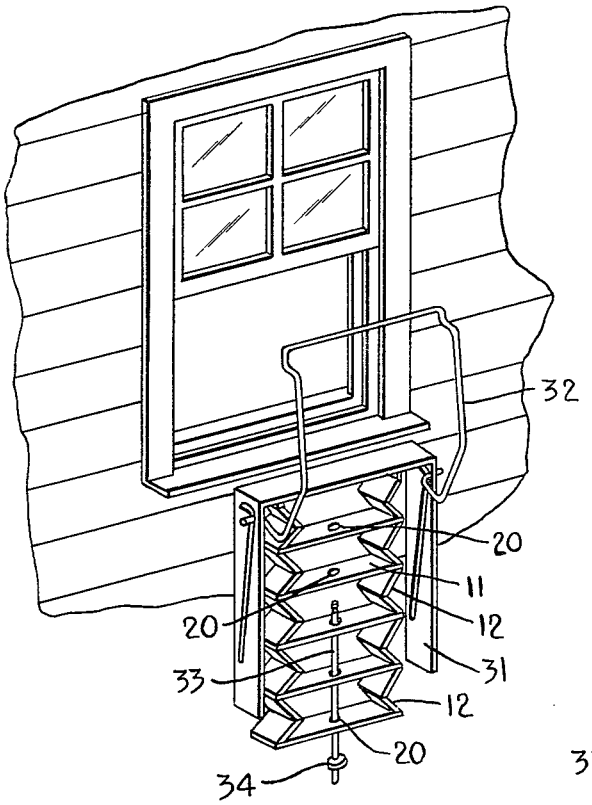
FIG. 4 is a perspective view similar to FIG. 2 showing a modification that includes a stacking rod.
Figure 5:
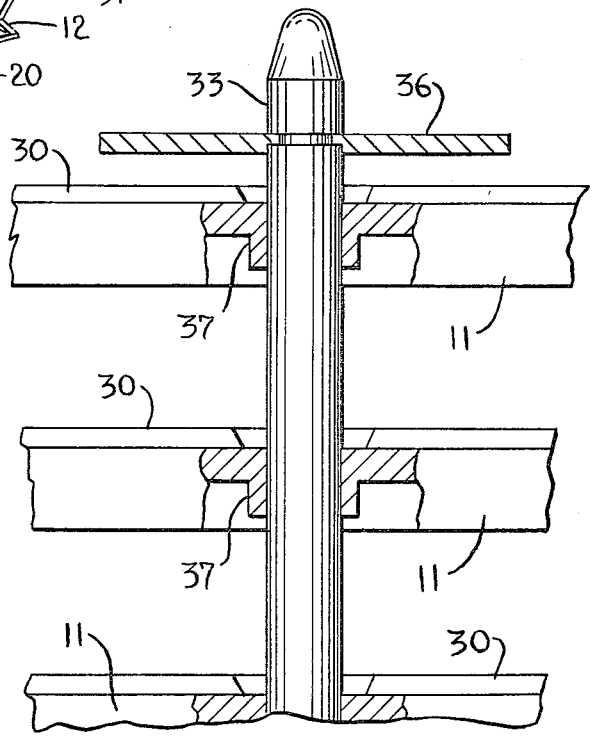
FIG. 5 is an enlarged fragmentary view, partially in section of the modification of FIG. 4, of the upper end of the stacking rod secured in place with a quick disconnect retaining ring.

Referring to FIGS. 4 and 5, the ladder may also be provided with a stacking rod 33 which simultaneously passes through apertures 20 to aid in maintaining the steps 11 in an aligned relation to each other when the ladder is folded. The stacking rod 33 has an enlarged portion 34 at one end to prevent that end from passing through apertures 20. The other end of the rod 33 is provided with a releasable enlarged portion such as a quick disconnect retaining ring 36, shown in detail in FIG. 5. A reinforcing collar 37, shown in FIG. 5, may be molded into the steps 11 to provide reinforcement around the apertures 20.

Figure 6:
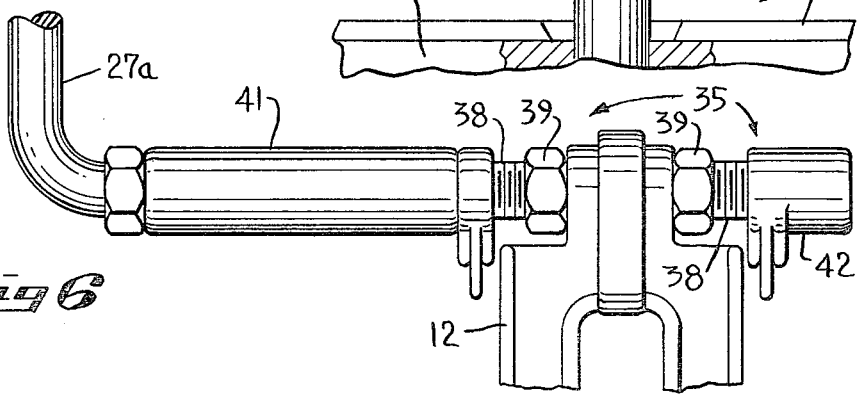
FIG. 6 is an enlarged fragmentary side elevational view of a modified embodiment that includes an adjustment linkage for the window rods.

A further modification, which aids in providing a more rigid feeling ladder for the person using it, provides for a length adjustment means such as adjustment linkage 35, for the hand rail **27*a*, as shown in FIG. 6. The hand rail 27*a* of FIG. 6 is similar to hand rail 27 of FIG. 1 except that it has an adjustment means such as adjustment link 35 for securing it to the link 12. The end of the hand rail 27*a* is provided with a threaded rod 38 and means for adjusting the position of the link 12 with respect to the threaded rod 38, for example adjustment nuts 39. By turning the nuts 39 on the threaded bar 38, the effective length of hand rail 27*a*** can be adjusted to the width of the window sill or other structure to which the the ladder is to be secured.

In a preferred embodiment means for shielding the threaded bar 38, such as guard 41, and for preventing accidental removal of the threaded bar 38, such as stop 42, are also provided on the ladder.

Operation

The operation of the above described embodiments of the invention is as follows:

When used as an emergency escape means, the ladder may be removed from storage and secured to a window or other convenient escape path, and permitted to unfold. The embodiment of FIG. 2 shows a ladder already secured outside of a window, and one need only release the cover of the box 31 to drop the ladder. Once the ladder is secured, for example to the window sill, as shown in FIG. 3, one need only step onto the ladder gripping the hand rail 32, and climb down. The weight of the person will act to hold the ladder relatively rigid and the stop means 15, when provided on the ladder, acts to aid in maintaining the ladder extended. Hand holds 28 and 29 may be provided for easy grasping by hand.

The ladder is folded simply by moving the steps 11 together with the links 12 folding towards each other in the direction A, B, respectively, as shown in FIG. 1. A stacking rod 33 may be inserted through apertures 20, and a quick disconnect retaining ring 36 inserted on the end passing through the apertures 20. This will aid in handling the ladder in its folded condition. If the retaining ring 36 is inserted over the end of the rod 33 protruding from the top step 11, it can be easily slipped off and the rod 33 allowed to fall out, thus releasing the ladder, as shown in FIG. 4.

The adjustment linkage 35 permits adjusting the position of the hand rail **27*a* relative to the ladder, whereby a firmer grip on the window sill or other wall support can be attained. This linkage 35** permits adjustment to various widths of window sills or other supports, for example the gunwalls of a boat when the ladder is used for marine purposes.

I wish it to be understood that I do not desire to be limited to the exact details of construction shown and described, for obvious modifications will occur to a person skilled in the art.

Having thus described the invention, what I claim as new and desire to be secured by Letters Patent, is as follows:

1. A foldable ladder of the type having a plurality of rigid steps and being operable between an operating position in which said ladder is suspended from an elevated structure and at least the majority of said steps are supported below said structure, and spaced apart from each other in a substantially parallel arrangement, and, respectively, a folded position in which said steps are disposed in close proximity to each other, the improvement comprising support means operable to maintain said ladder rigidly in said operating position and, respectively, to permit said ladder to be folded into said folded position, and including a plurality of rigid links pivotally secured together and to said steps, wherein each rigid step defines an aperture, said apertures being substantially aligned with each other, a stacking rod operable to extend through said apertures to maintain said steps in substantially aligned relation to each other in said folded position, said rod including an enlarged portion near one end to restrain the passage of that end through an aperture, and a quick disconnect retaining ring removably insertable over the opposite end of the rod, said ring when inserted being operable to secure said rod within said apertures.

* * * * *